US005992617A

United States Patent [19]

Couch et al.

[11] Patent Number: 5,992,617

[45] Date of Patent: Nov. 30, 1999

[54] PAINTING IMPLEMENT KEEPER

[76] Inventors: Robert Lincoln Couch; Ronald Norman Couch, both of 1820 Schaeffer Rd., Knoxville, Tenn. 37932

[21] Appl. No.: 09/005,421

[22] Filed: Jan. 9, 1998

Related U.S. Application Data

[63] Continuation-in-part of application No. 08/742,746, Nov. 1, 1996, Pat. No. 5,709,301.

[51] Int. Cl.[6] ..... B65D 39/14; A45D 44/18

[52] U.S. Cl. ..... 206/15.3; 206/15.2; 206/361; 220/736; 220/702; 215/391; 215/390

[58] Field of Search ..... 206/15.2, 15.3, 206/361, 362, 446, 408, 323, 591, 592; 220/735, 736, 902, 212; 215/228, 390, 391, 364

[56] References Cited

U.S. PATENT DOCUMENTS

| | | | |
|---|---|---|---|
| 501,282 | 7/1893 | Leggett | 206/15.3 |
| 1,110,533 | 9/1914 | Carmichael | 206/15.2 |
| 1,202,355 | 10/1916 | Bernhardt | 206/361 |
| 1,533,318 | 4/1925 | Ihling | 206/15.2 |
| 1,655,950 | 1/1928 | Griswold | 206/15.2 |
| 2,138,319 | 11/1938 | Bilbrey | 206/15.3 |
| 2,262,753 | 11/1941 | Brennan | 206/15.3 |
| 2,533,355 | 12/1950 | Comfort . | |
| 2,782,909 | 2/1957 | McNamara . | |
| 3,209,387 | 10/1965 | Lukesch | 206/15.2 |
| 3,918,582 | 11/1975 | Wallace . | |
| 4,533,044 | 8/1985 | Ban . | |
| 4,771,501 | 9/1988 | Leiter . | |
| 5,301,799 | 4/1994 | Gurba, Jr. . | |
| 5,341,969 | 8/1994 | Accardo et al. . | |
| 5,540,363 | 7/1996 | Wilson | 206/15.2 |

FOREIGN PATENT DOCUMENTS

| | | |
|---|---|---|
| 585262 | 10/1959 | Canada . |
| 2351248 | 4/1975 | Germany . |
| 92/20596 | 11/1992 | WIPO . |

*Primary Examiner*—Paul T. Sewell
*Assistant Examiner*—Anthony Stashick
*Attorney, Agent, or Firm*—Richard C. Litman

[57] ABSTRACT

Storage devices for paint rollers, paint roller covers, and paint brushes. The storage devices for the paint rollers and paint roller covers are cylindrical containers, having a lid, which are flared outwardly at their upper portions and have a foam insert at the bottom for forming a spongy seal with the painting implement. The container for the cover has a core in it over and around which the roller cover fits. The paint implement holder may be a foam insert which is sized to fit inside of a paint can, e.g. a one or a five gallon can. The foam inserts have openings for receiving one or more paint implements. Alternatively, the paint brush holder is a rectangular-shaped container having a foam insert fitted to its upper portion. The exterior of the insert is sized to fit the container. The insert has an opening for holding a paint brush collar to allow the bristles to be in the container without touching the bottom. The insert keeps the brush wet and from drying out. Additionally, the invention encompasses devices to grip the handle of a paint implement so that it can be submerged in paint during storage.

7 Claims, 6 Drawing Sheets

PAINTING IMPLEMENT KEEPER

CROSS REFERENCE TO RELATED APPLICATION

This application is a Continuation-In-Part of application Ser. No. 08/742,746, filed Nov. 1, 1996 now U.S. Pat. No. 5,709,301.

BACKGROUND OF THE INVENTION

1. Field of the Invention

The present invention relates to storage devices for painting implements, specifically paint rollers, covers, and paint brushes.

2. Description of the Related Art

Containers for storing painting implements are well-known in the related art. For example, U.S. Pat. No. 2,782,909, issued on Feb. 26, 1957 to Paul E. McNamara, teaches a retaining sleeve for holding a paint brush in a container. Unlike this prior apparatus, the instant invention can be used to hold different sizes of brushes merely by replacing the insert because it holds the brush at the collar, which varies with the size of the brush. Further, the instant invention maintains a foam insert in contact with the paint implement to prevent its drying out.

U.S. Pat. No. 5,341,969, issued on Aug. 30, 1994 to Carl Accardo et al., a lid for covering a painting container and having openings for allowing the protrusion of a brush or roller. However, the instant foam insert which provides the spongy seal is lacking.

Less relevant patents and publications generally describing containers for use with paint brushes include U.S. Pat. No. 2,533,355 issued to Comfort, U.S. Pat. No. 3,918,582 issued to Wallace, U.S. Pat. No. 4,533,044 issued to Ban, U.S. Pat. No. 4,771,501 issued to Leiter; U.S. Pat. No. 5,301,799 issued to Gurba, Jr.; and foreign publications from Canada No. 585,262, Germany No. 2,351,248, and WO No. 92/20,596. Therefore, it is desired to provide an insert that allows for the protrusion of brushes and rollers while preventing them from drying out.

SUMMARY OF THE INVENTION

The present invention relates to storage devices for paint rollers, paint roller covers, and paint brushes. The storage devices for the paint rollers and paint roller covers are cylindrical containers, having a lid, which are flared outwardly at their upper portions and have a foam insert at the bottom for forming a spongy seal with the painting implement. The container has a cylindrical core over which closely fits a roller cover. The lid, which can be either a screw down or a friction fit lid, has a foam insert on its underside to form a spongy seal with the upper part of the roller cover.

The container for the roller and the lid, which must be a friction fit lid, each have a semicircular opening lined with a gasket. The mating of the container and the lid also form of a circular opening through which the handle of a roller frame can extend.

The paint implement holder may be a foam insert which is sized to fit inside of a paint can, e.g. a one or a five gallon can. The foam inserts have openings for receiving one or more paint implements.

Alternatively, the paint brush holder may be a rectangular-shaped container having a foam insert fitted to its upper portion. The exterior of the insert is sized to fit the container.

The insert has an opening for holding a paint brush collar to allow the bristles to be in the container without touching the bottom. The insert keeps the brush wet and from drying out. The insert can be replaced with an insert having the same exterior size, which will fit the container, and a different sized interior surface, to hold another size of paint brush.

Additionally, the invention encompasses devices to grip a paint implement handle so that it can be submerged in paint during storage. Covers provided with these devices prevent air from entering the system in which the painting implement is stored.

In use, the containers are filled with paint so as to cover the paint retaining portion of the painting implement. This submerging of the implement in paint keeps the painting implement wet so that it will not dry out. Additionally, storing the painting implement in this manner means that it does not have to be cleaned with paint thinner after each use.

Accordingly, it is a principal object of the invention to provide storage devices for a paint roller, a paint roller cover, and a paint brush.

It is another object of the invention to minimize the quantity of paint thinner used.

Still another object of the invention is to provide the storage devices with foam inserts to prevent the painting implement from drying out.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The presently claimed paint implement keepers can be used to store paint rollers, paint roller covers, or paint brushes while keeping the painting surface wet with paint. Such an invention reduces the frequency which paint implements must be cleaned and the amount of paint thinner which must be used, resulting in a great environmental benefit. The paint implement keepers are filled with paint and foam inserts maintain a spongy contact with the paint implement, keeping the implement wet.

Figure 1:
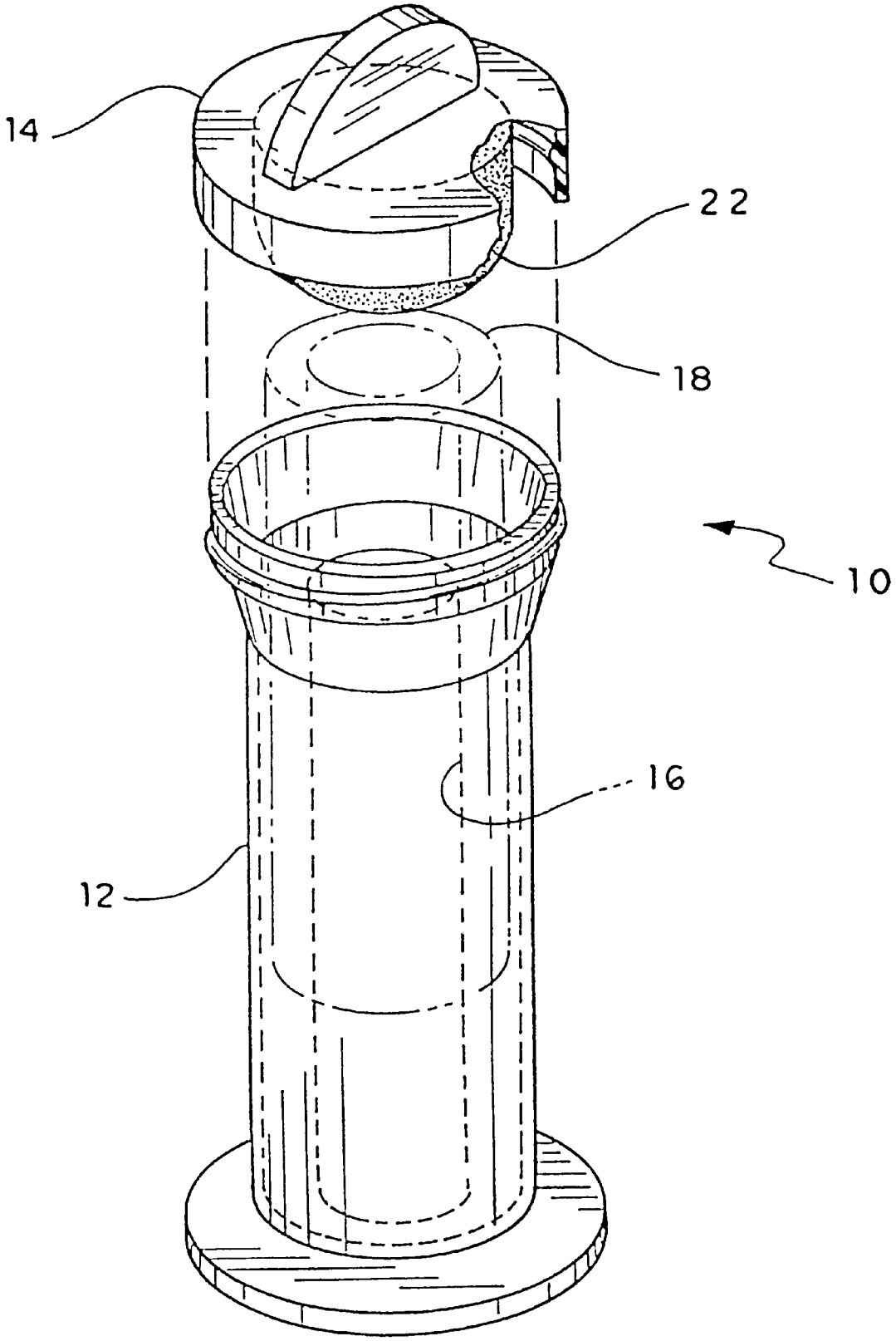
FIG. 1 is a partially broken-away, partially exploded perspective view of a storage device for a paint roller cover.
Figure 2:
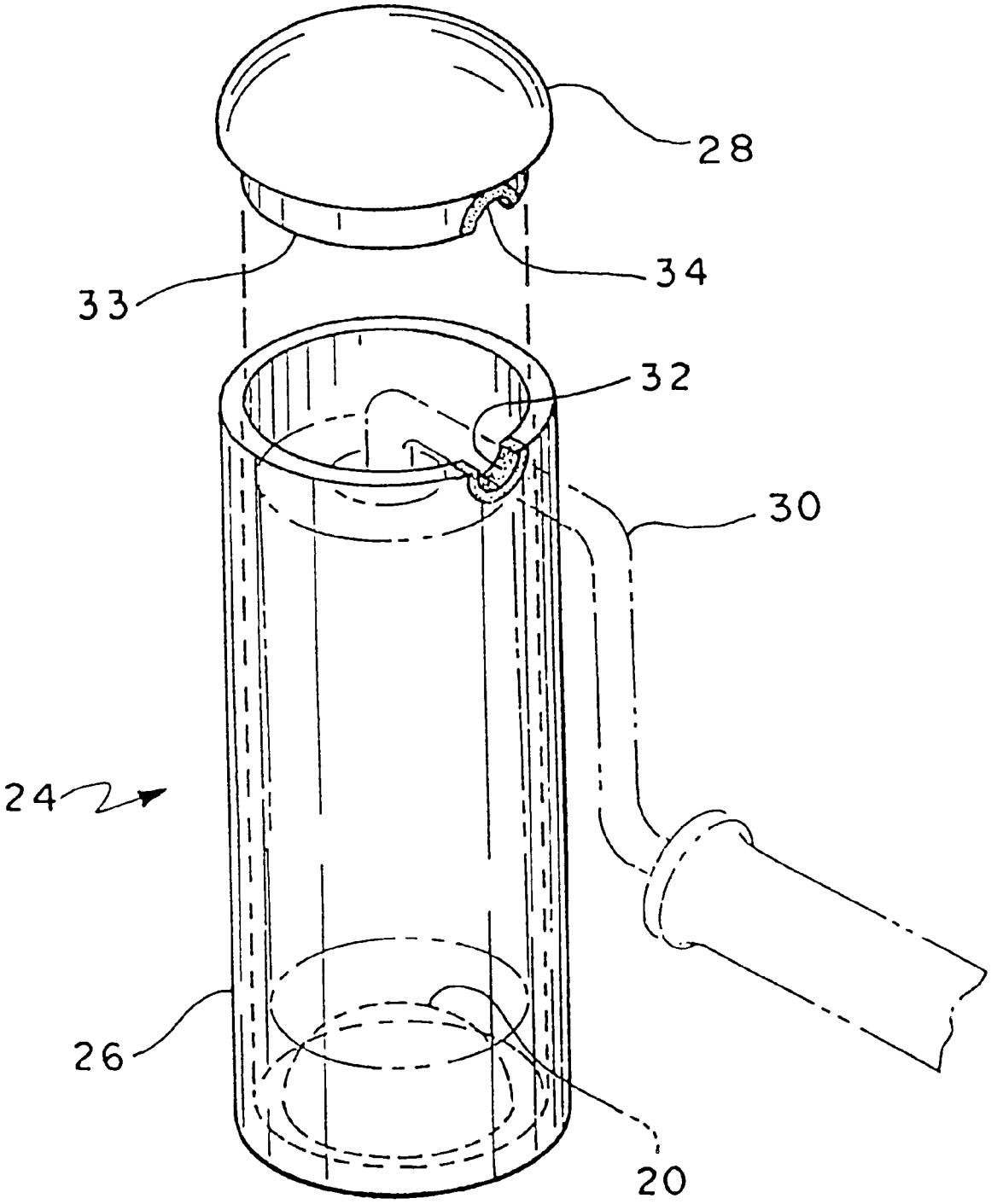
FIG. 2 is a partially exploded, perspective view of a storage device for a paint roller with environmental features shown in broken lines.

FIGS. 1 and 2 show a paint implement keeper which is used for storing a paint roller or a paint roller cover. FIG. 1 shows a paint roller cover keeper 10, which includes a container 12 having a threaded lip and a screw down lid 14. The container 10 includes a core 16 with a closed top over which the paint roller cover 18 is placed. The core 16 serves the purpose of holding the roller cover 18 in place and, more importantly, taking up volume in the container, reducing the amount of paint required to fill up the container 10. The bottom of the container 10 includes a foam rubber insert 20 (shown in FIG. 2) and the underside of the lid 14 includes a foam rubber insert 22 to form a seal with the paint roller cover 18 and keep it moist when submerged in paint. The upper portion of the container 12 is flared outwardly to prevent paint overflow.

The paint roller cover keeper 10 can also utilize a friction fit lid and container. This configuration is seen in FIG. 2 in conjunction with a paint roller keeper 24. The paint roller keeper 24 includes a container 26 and a lid 28, having a cylindrical flange 33. The flange 33 frictionally fits into the container 26. While the paint roller cover keeper 10 can utilize either a screw down or a friction type configuration, the paint roller keeper 24 can use only the friction type configuration because of the protruding paint roller frame 30. The paint roller frame 30 protrudes out of an opening formed by a semi-circular notch opening 32 at an upper portion of the container 26 and a semi-circular notch opening 34 in the circumferential flange 33 of the lid. When the lid 28 is placed on the container 26, the paint roller frame 30 is surrounded by a gasket-like circular opening.

Figure 3:
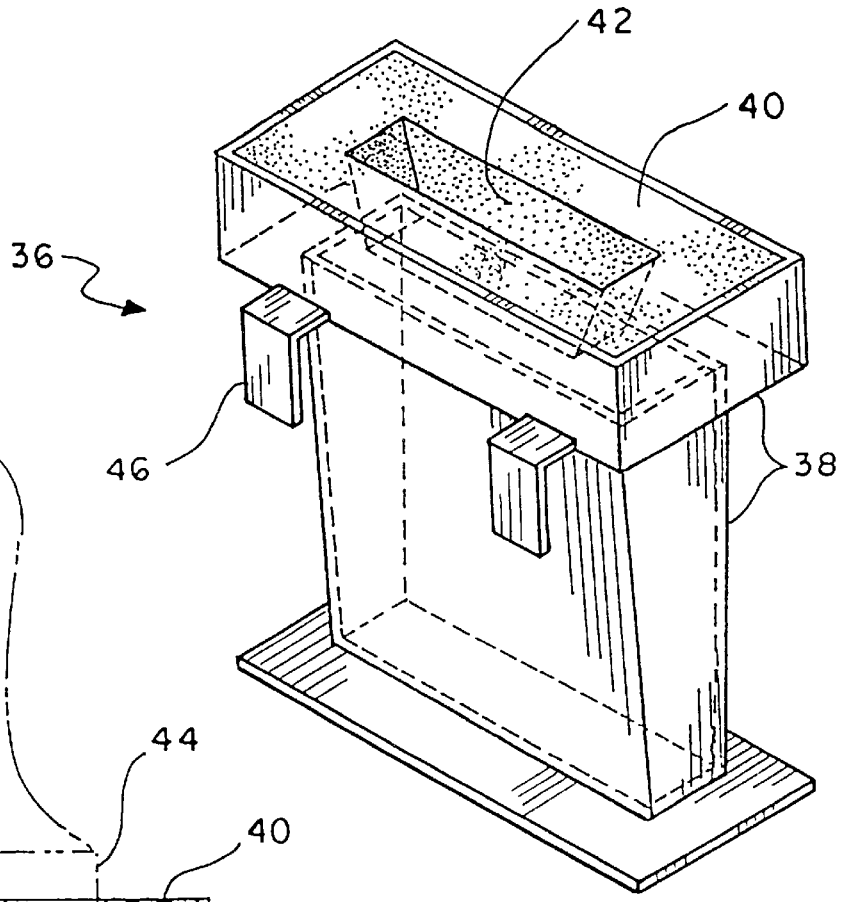
FIG. 3 is a perspective view of a storage device for a paint brush.
Figure 4:
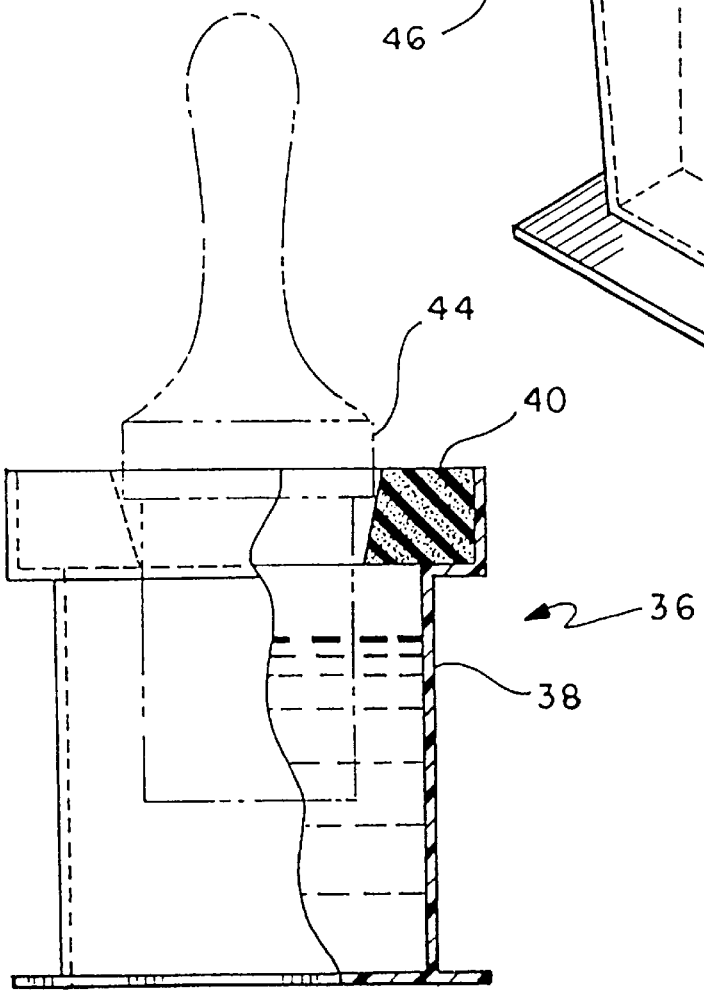
FIG. 4 is a front view of a storage device for a paint brush partially shown in cross section with environmental features shown in broken lines.

The paint brush keeper 36, which is shown in FIGS. 3 and 4, includes a rectangular-shaped container 38 and an insert 40 made of cellular material, preferably foam. The container 38 has a lower portion and a larger upper portion. The insert 40 has an opening with an inner surface 42. The size, length, width, and depth, of the insert 40 is such that it will fit into the upper portion of the container 38. The opening in the insert 40 is sized to accommodate a paint brush by frictionally holding the collar 44 of the brush. Different inserts having the same exterior dimensions and different sized openings, can be used with the container 38 for different sized brushes. Inserts 40 having different sized openings have different sized inner surfaces 42 for holding different sized paint brush collars 44. The paint brush keeper 36 has two hooks 46 so that it can be hooked onto a paint can.

Figure 5:
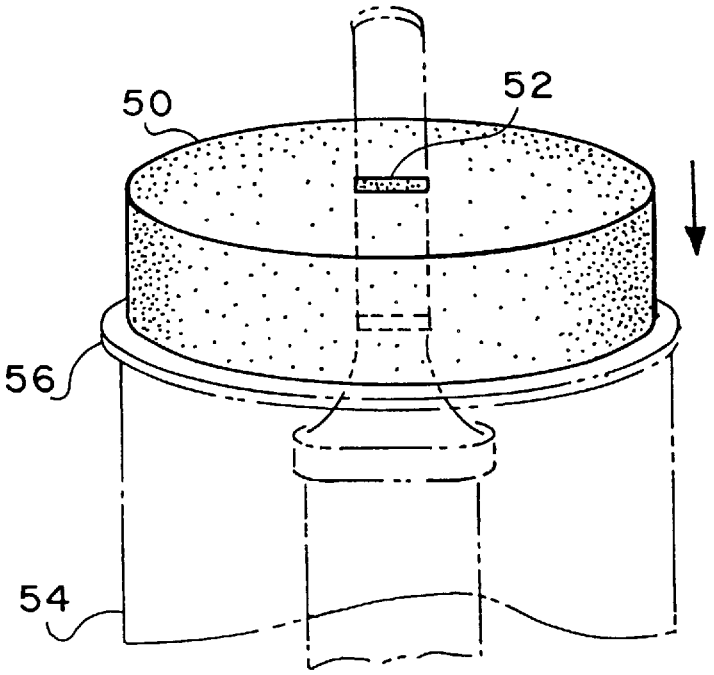
FIG. 5 is a perspective view of an insert for a one gallon paint can with environmental features shown in broken lines.
Figure 6:
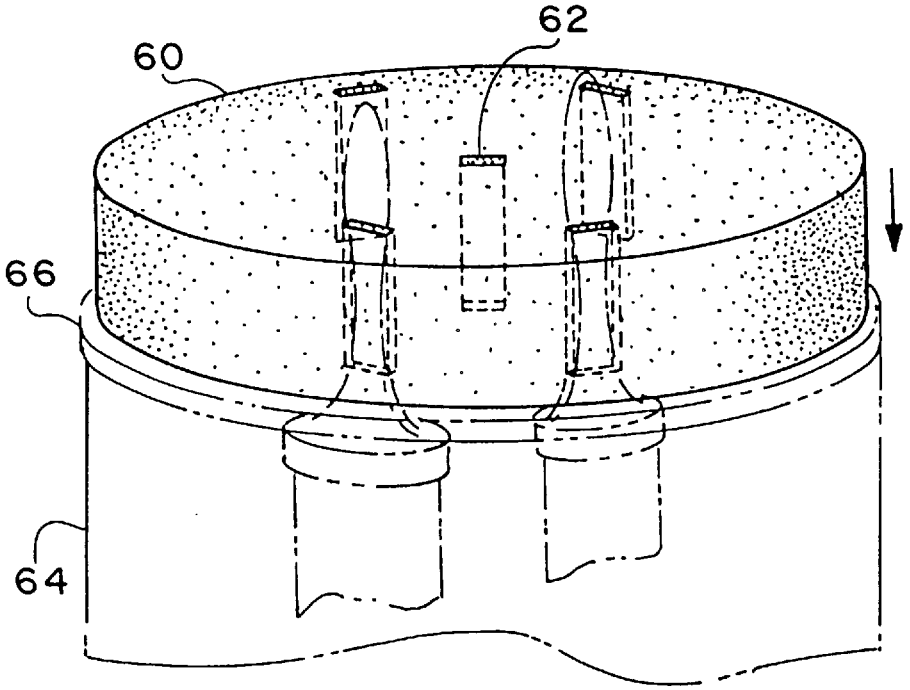
FIG. 6 is a perspective view of an insert for a five gallon paint can with environmental features shown in broken lines.

An insert 50 for a one gallon paint can 54 and an insert 60 for a five gallon paint can 64 are shown in FIGS. 5 and 6, respectively. The inserts 50 and 60 are made of cellular material, preferably foam. The handles of paint brushes or paint rollers are held in openings in the inserts 50 and 60. Insert 50 has one opening 52 and insert 60 may have several openings 62, preferably five. The inserts 50 and 60 are inserted in the cans 54 and 64 with the upper surface of the inserts 50 and 60 being flush with the respective lips 56 and 66 of the cans 54 and 64 as indicated by the arrows in FIGS. 5 and 6. A layer of plastic, i.e. a plastic liner, can be provided between the inserts 50 and 60 and the cans 54 and 64. This plastic liner helps to keep the inserts 50 and 60 from drying out. However, even without the plastic liner, the inserts 50 and 60 form a spongy seal to maintain the wetness of the brush or roller. It is noted that the concept of the foam insert can be applied to rectangular roller pans or any other painting containers, such as that taught in U.S. Pat. No. 5,341,969, merely by changing the shape of the insert.

Figure 7:
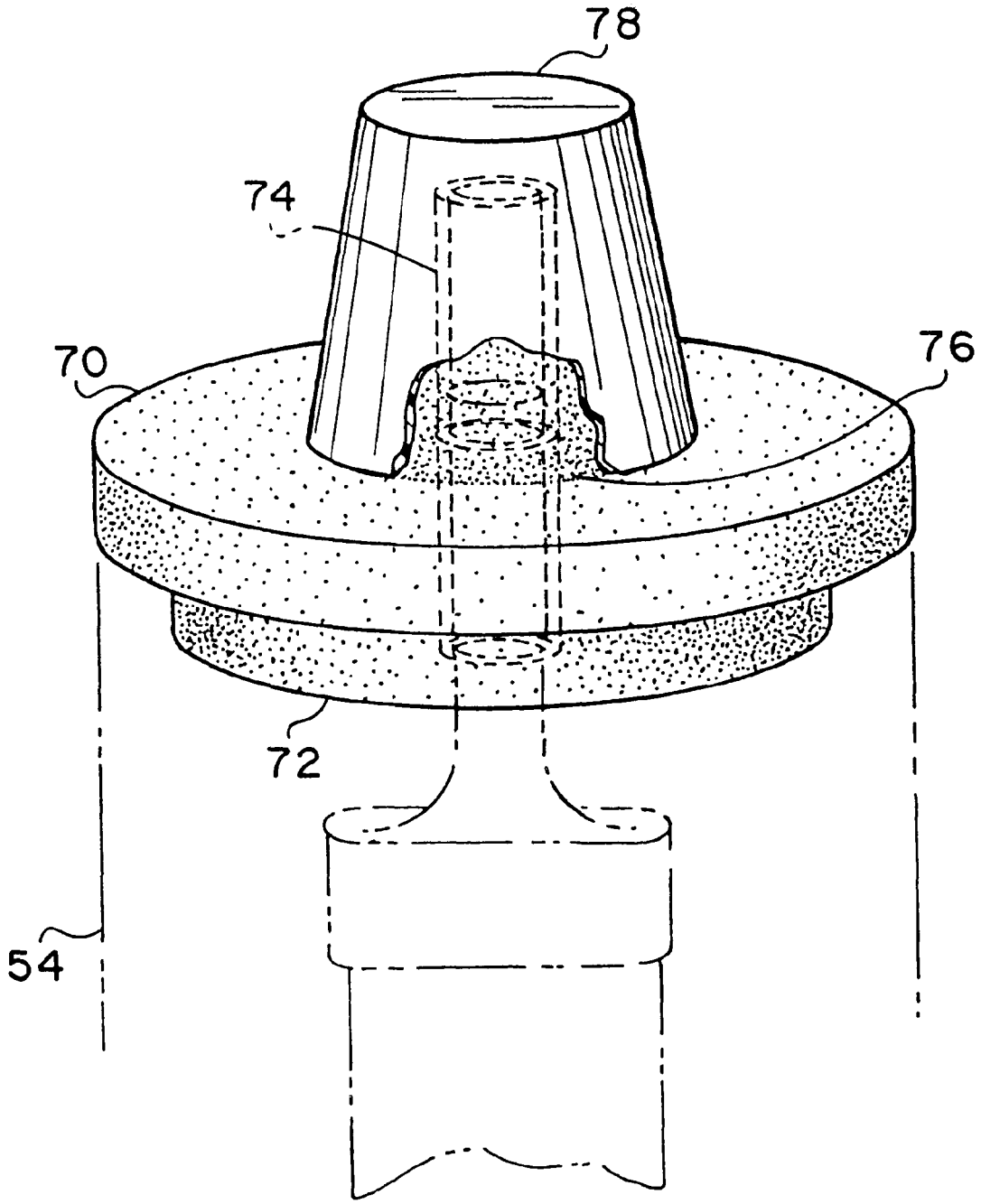
FIG. 7 is a perspective view of an insert for holding and covering a paint brush with environmental features shown in broken lines.
Figure 8:
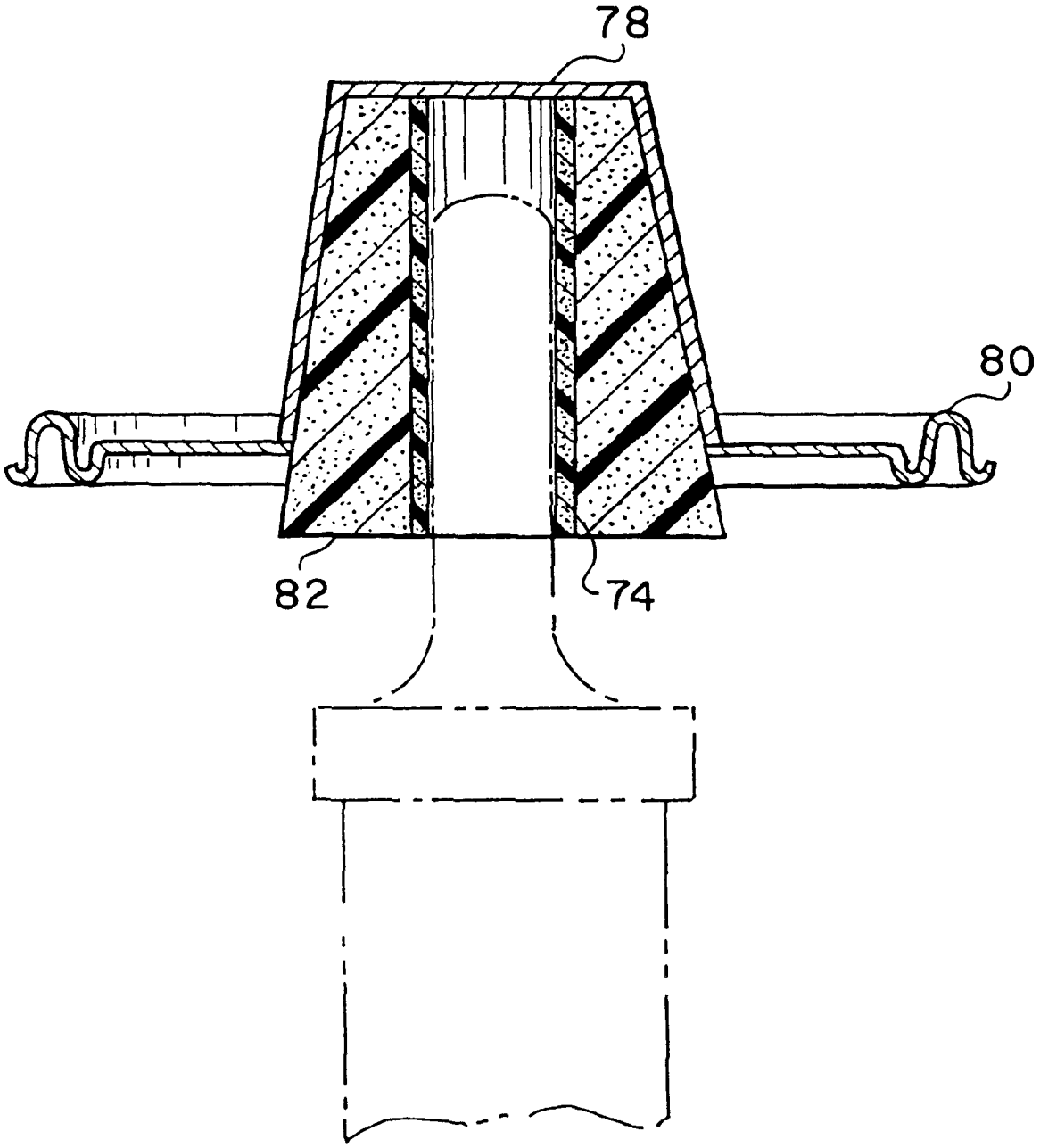
FIG. 8 is a front cross-sectional view of a modified paint can lid for holding and covering a paint brush with environmental features shown in broken lines.

FIGS. 7 and 8 show other types of devices for holding a painting implement in a paint can 54. These figures show a paint brush being held by a cellular material, preferably, foam insert 70 or a paint can lid 80 each having a through-bore. Both the insert 70 and the lid 80 have a conical cover 78 and a implement-holding sleeve 74 of denser foam material. The conical cover 78 completely closes the can in which the implement is stored and keeps air out of the system, further adding to the longevity of the storage and reducing the fire hazard of an open paint can.

The insert 70 includes a layer of foam 72, which has a smaller circumference, on its underside. This layer of foam 72 increases the surface area available to provide for a spongy seal. This function is also accomplished by foam 82 (as seen in FIG. 8) with respect to the lid 80. Foam 82 protrudes through a bore in the lid 80, and, along with lid 80, forms an insert. Foam 82 also provides a friction fit for the implement-holding sleeve 74 within the conical cover 78. As seen in FIG. 7, this function is provided by foam 76 in association with insert 70.

It is to be understood that the present invention is not limited to the embodiments described above, but encompasses any and all embodiments within the scope of the following claims.

We claim:

1. In combination with a container, a paint implement storage device comprising:

an insert of cellular material having an opening for receiving a handle of a painting implement;

a cover extending upwardly from said insert and including a foam sleeve, which is denser than said cellular material, for snugly fitting around a handle of a painting implement.

2. The combination of claim 1 wherein said cellular material is foam.

3. The combination of claim 1 wherein said container is a paint can.

4. The combination of claim 3 wherein said insert is round.

5. The combination of claim 1 wherein said cellular material is foam.

6. The combination of claim 5 further including a second piece of foam material below said insert.

7. The combination of claim 1 wherein each said cover is conical.

* * * * *